US005865666A

United States Patent [19]

Nagahara

[11] Patent Number: 5,865,666

[45] Date of Patent: Feb. 2, 1999

[54] APPARATUS AND METHOD FOR POLISH REMOVING A PRECISE AMOUNT OF MATERIAL FROM A WAFER

[75] Inventor: Ron J. Nagahara, San Jose, Calif.

[73] Assignee: LSI Logic Corporation, Milpitas, Calif.

[21] Appl. No.: 915,000

[22] Filed: Aug. 20, 1997

[51] Int. Cl.[6] ..... B24B 1/00; H01L 21/00

[52] U.S. Cl. ..... 451/10; 451/11; 451/41; 451/285; 451/288; 438/691; 438/692

[58] Field of Search ..... 451/9, 10, 11, 451/41, 285, 287, 288, 289; 438/14, 17, 692

[56] References Cited

U.S. PATENT DOCUMENTS

| | | | |
|---|---|---|---|
| 5,191,738 | 3/1993 | Nakazato et al. | 451/288 |
| 5,298,110 | 3/1994 | Schoenborn et al. | 451/8 |
| 5,308,438 | 5/1994 | Cote et al. | 451/41 |
| 5,499,733 | 3/1996 | Litvak . | |
| 5,536,202 | 7/1996 | Appel et al. . | |
| 5,664,989 | 9/1997 | Nakata et al. | 451/285 |
| 5,672,095 | 9/1997 | Moromoto et al. | 451/41 |

*Primary Examiner*—Eileen P. Morgan

[57] ABSTRACT

An apparatus and method are presented for polishing removal of a select amount of material from a surface of a semiconductor wafer. The apparatus includes a polishing pad having a moveable planar polishing surface. The surface of the semiconductor wafer and a surface of at least one sacrificial member are retained against the polishing surface. A measurement system determines an amount of material removed from the surface of the sacrificial member. The measurement system includes a sensor unit for each sacrificial member coupled to a computational device. Each sensor unit is used to determine the amount of material remaining at the surface of the corresponding sacrificial member. The computational device determines the amount of material removed from the surface of each sacrificial member based upon the amount of material remaining at the surface. The amount of material removed from the surface of the sacrificial member corresponds to an amount of material removed from the surface of the semiconductor wafer. The computational device uses a correlation between the material removal rates due to polishing (i.e., polish rates) of the sacrificial member and the material upon the surface of the semiconductor wafer to determine when a desired amount of material has been removed from the surface of the semiconductor wafer.

19 Claims, 7 Drawing Sheets

APPARATUS AND METHOD FOR POLISH REMOVING A PRECISE AMOUNT OF MATERIAL FROM A WAFER

BACKGROUND OF THE INVENTION

1. Field of the Invention

This invention relates to an apparatus and method for performing chemical-mechanical polishing ("CMP") upon a substrate and for accurately terminating CMP.

2. Description of Related Art

During a wafer fabrication process, multiple integrated circuits are formed upon frontside surfaces of each of several semiconductor wafers processed somewhat concurrently. Each integrated circuit consists of electronic devices electrically coupled by conductive traces called interconnects. Interconnects are patterned from conductive layers formed on the surface of a semiconductor wafer. The ability to form stacked layers of interconnects has allowed more complex circuits to be implemented in and on relatively small surface areas of silicon substrates. The individual interconnect levels of multilevel interconnect structures are separated by layers of electrically insulating materials (i.e., interlevel dielectric layers).

As the number of interconnect levels is increased, the stacking of additional interconnect layers on top of one another tends to increase the elevational disparities in frontside surface topographies. Problems arise when attempting to form interconnects upon rugged frontside surface topographies. Abrupt elevational changes in the frontside surface topography of a semiconductor wafer typically occur at or near lateral edges of underlying patterned features, e.g., interconnects. The tendency of layers formed upon the surface topography of a semiconductor wafer to be thinner over such abrupt elevations changes (i.e., "steps") is referred to as the "step coverage" problem. In additional to the step coverage problem, large and abrupt elevation disparities lead to depth of focus problems. Depth of focus problems become an issue during the lithographic process in which layers are patterned across a semiconductor topography. A major factor in the processing of integrated circuits with submicron device dimensions is the limited depth of focus of the optical steppers used to pattern circuit features. In order to obtain maximum resolutions, imaging surfaces must be fairly planar with a suitable elevational disparity less than about 0.5 microns. Accordingly, interlevel dielectric planarization techniques must be employed in order to make imaging surfaces substantially planar.

CMP is a popular method of planarizing the upper surface of a layer (e.g., an interlevel dielectric layer) formed upon the frontside surface of a semiconductor wafer. CMP combines chemical etching and mechanical buffing to remove raised features upon the frontside surface of the semiconductor wafer. During an exemplary CMP process, the semiconductor wafer is inverted whereby the frontside, circuit embodied surface faces downward upon a polishing pad preferably saturated with a liquid slurry containing abrasive particles and a mild etchant chemical which softens or catalyzes the exposed material being planarized. The polishing pad is fixedly attached to a rotatable table or platen. When the rotatable table or platen is set into motion, elevationally extending portions of the frontside surface are removed by combined chemical softening of the exposed surface material and physical abrasion brought about by relative movement between the polishing pad and the frontside surface.

In CMP operations, it is important to be able to detect when sufficient planarization of the frontside surface topography has been achieved and to stop the CMP process in order to avoid removing too much material at the frontside surface (e.g., interlevel dielectric material). FIG. 1*a* is a side elevation view of an exemplary CMP apparatus 10 including elements used to detect end point conditions. A backside surface of a semiconductor wafer 12 is held against a rotatable polishing wheel 14. An opposed frontside surface of semiconductor wafer 12 has multiple layers of select materials formed thereupon. The frontside surface of semiconductor wafer 12 is brought into contact with a layer of an abrasive polishing fluid (i.e., slurry) existing between semiconductor wafer 12 and polishing pad 16. Polishing pad 16 is fixedly attached to a rotatable platen 18. Polishing wheel 14 may include a hollow shaft 20 attached at its center of rotation. During use, shaft 20 may be rotated by motor 22 through drive train 24, and platen 18 may also be rotated such that polishing pad 16 moves, orbits and/or rotates relative to semiconductor wafer 12.

Apparatus 10 may also include a light source 26 and a light detector 28. Light source 26 emits an incident beam of light 30 directed through hollow shaft 20 substantially perpendicular to the backside surface of semiconductor wafer 12. Incident light beam 30 includes one or more wavelengths at which semiconductor wafer 12 is substantially transparent (e.g., infrared radiation having longer wavelengths than visible light). A portion of incident light beam 30 reflected back from semiconductor wafer 12 and toward light detector 28 forms a reflected light beam 32.

FIG. 1*b* is an exploded view of the portion of FIG. 1*a* illustrating formation of reflected light beam 32 from incident light beam 30. In FIG. 1*b*, a first dielectric layer 34 exists directly upon the frontside surface of semiconductor wafer 12. Interconnects 36 are formed upon first dielectric layer 34, and a second dielectric layer 38 is formed over interconnects 36. An exposed surface of second dielectric layer 38 is being planarized using apparatus 10. A layer of an abrasive slurry 40 is interposed between second dielectric layer 38 and polishing pad 16 to effectuate planarization.

A portion of incident light beam 30 is reflected back toward light detector 28 at the backside surface of semiconductor wafer 12 and at each interface between the layers formed upon the frontside surface of semiconductor wafer 12, forming reflected light beam 32. These reflected portions interfere with one another, adding together to produce a greater intensity when they are in phase with one another and subtracting from one another to produce a lesser intensity when they are out of phase. Of prime importance is a component 42 of reflected light beam 32 reflected from the exposed surface 44 of second dielectric layer 38. When exposed surface 44 is not substantially planar, the contribution of component 42 to reflected light beam 32 is negligible. When exposed surface 44 becomes substantially polished and planar during the CMP operation, however, the contribution of component 42 to reflected light beam 32 is significant. As the CMP operation is continued after second dielectric layer 38 becomes polished and substantially planar, relatively small but detectable cyclic changes begin to occur in the intensity of a monitored wavelength of reflected light beam 32 resulting from the thinning of second dielectric layer 38 and the consequent phase changes of component 42. See, e.g., U.S. Pat. No. 5,499,733 (herein incorporated by reference).

FIGS. 1*a–b* represent a highly simplified example in which semiconductor wafer 12 includes only a single interconnect layer. Modern integrated circuits typically have several levels of interconnects separated by one or more layers of interlevel dielectrics. Contributions to reflected light beam 32 from reflections at the multiple interfaces between the interlevel dielectric layers represent a substantial background noise level against which relatively small cyclic changes in the intensity of reflected light beam 32 must be detected. The result is a high degree of ambiguity in CMP end point detection which increases with the number of integrated circuit interconnect levels.

It would thus be desirable to have an automatic CMP end point detection apparatus and accompanying method which: (i) minimize the number of contributions influencing end point detection, and (ii) make end point detection independent of the number of integrated circuit interconnect levels. The desired apparatus and method would allow CMP processes to be more closely controlled, resulting not only in better step coverage and depth of focus but also providing closer interlevel dielectric thickness tolerances and more predictable interconnect electrical characteristics.

SUMMARY OF THE INVENTION

The problems outlined above are in large part solved by an improved apparatus and method for detecting end point polishing of a multi-layered substrate. According to one embodiment, the substrate can be a semiconductor wafer. However, it is recognized that the present polishing technique can be applied to a substrate not limited to a semiconductor wafer. Accordingly, whenever "wafer" is referenced hereinbelow, it applies to any material composition which can be polished and is configured as a wafer or disk. Thus, "wafer" refers to the shape of the item being polished and not necessarily to a semiconductor-type wafer. Thus, wafer includes any device manufactured having a defined thickness and diameter used, for example, in manufacturing or in trade, a suitable disk-shaped wafer includes, for example, a CD-ROM, etc.

A first embodiment of the apparatus includes a polishing pad which may rotate about a central axis and has a substantially planar polishing surface. The apparatus may further include a retaining structure for retaining a surface of the wafer and each of several sacrificial members against the polishing surface of the polishing pad. Yet further, the apparatus includes a measurement system for determining an amount of material removed from each of the sacrificial members. The measurement system includes multiple sensor units, one for each sacrificial member, coupled to a computational device. Each sensor unit includes a transmitter for transmitting a signal and a receiver for receiving a reflected portion of the signal. The reflected portion of the signal conveys information as to the amount of material remaining at the surface of the corresponding sacrificial member. The computational device determines the amount of material removed at the surface of each sacrificial member based upon the amount of material remaining thereto. The computational device also calculates the average amount of material removed from the surfaces of the sacrificial members which corresponds to an amount of material removed from the surface of the wafer. Thus, by design, the sacrificial materials are placed around a periphery of the wafer and move in relation to the wafer so they can be polished at approximately the same rate as the wafer.

The computational device uses a correlation between the material removal rates due to polishing (i.e., polish rates) of the sacrificial member and the material upon the surface of the wafer to determine when a desired amount of material has been removed from the surface of the wafer. The computational device preferably produces one or more signals which control the operation of the apparatus. The computational device may, for example, issue a termination signal which causes operation of the apparatus to cease when a desired amount of material has been removed from the wafer.

One embodiment of the retaining structure comprises an underside surface and a central chamber. The underside surface has an opening to the central chamber dimensioned to receive the semiconductor wafer. The central chamber is cylindrical, and an axis of the central chamber is substantially orthogonal to the planar polishing surface of the polishing pad. The retaining structure also includes multiple sensor chambers radially displaced from the axis of the central chamber. The underside surface also has an opening to each of the sensor chambers, and each sensor chamber opening is dimensioned to receive a sacrificial member. The retaining structure preferably rotates about an axis through the center of the semiconductor wafer orthogonal to the planar polishing surface of the polishing pad.

A wafer carrier is positioned within the central chamber and adapted to move axially within the central chamber. During use, the semiconductor wafer is positioned between the wafer carrier and the polishing pad. The central chamber also includes an opening through which a fluid is introduced into the central chamber during use such that the fluid exerts pressure upon the wafer carrier. The fluid pressure urges the wafer carrier and the wafer toward the polishing surface of the polishing pad.

A disk is positioned within each of the sensor chambers and adapted to move axially within the sensor chamber. A sacrificial member is interposed between the disk and the polishing pad. Openings extending between the central chamber and each of the sensor chambers allows the fluid introduced into the central chamber to also enter each sensor chamber. The fluid pressure between the central chamber and each sensor chamber is desirably regulated so that the downward force is substantially equal regardless of the volume within each chamber. The fluid pressure urges the disk and the sacrificial member toward the polishing surface with substantially equal force to preferably effectuate equal polish thereon.

In a second embodiment, the apparatus includes a sensor element separate from the retaining structure. The sensor element has a substantially planar underside surface and a sensor chamber. An opening to the sensor chamber within the underside surface is dimensioned to receive the sacrificial member. The sensor chamber is cylindrical, and an axis of the sensor chamber is substantially orthogonal to the planar polishing surface of the polishing pad. The sensor element includes a disk positioned within the sensor chamber and adapted to move axially within the sensor chamber. The sacrificial member is arranged within the sensor chamber between the disk and the polishing pad. The sensor chamber also includes an opening through which a fluid may be introduced into the sensor chamber. The fluid pressure urges the disk and the sacrificial member toward the polishing surface of the polishing pad. When the polishing pad rotates, the angular velocity of the rotating polishing pad is preferably equal at the centers of the sacrificial element and the semiconductor wafer.

A third and a fourth embodiment are analogous to the first and second embodiments, respectively, except that instead of rotating about a central axis, the polishing pad is directed in linear motion, possibly along a belt.

A method of achieving a desired thickness of a layer of a material upon a wafer is further contemplated. The method provides an apparatus having varying features, including at least one sacrificial members and a measurement system for monitoring polish effects thereon. A required change in dimension of the sacrificial member orthogonal to the planar polishing surface of the polishing pad corresponds to the desired final thickness of the layer of material upon the wafer. The polishing pad is then moved relative to the surfaces of the semiconductor wafer and the sacrificial member until the required change of dimension of the sacrificial member is achieved.

The determination of the required change in the dimension of the sacrificial member includes determining the change in dimension of the sacrificial member orthogonal to the planar polishing surface of the polishing pad per unit of polishing time and the change in thickness of the layer upon the surface of the semiconductor wafer per unit of polishing time. A relative change value is then calculated by dividing the change in dimension of the sacrificial member per unit of polishing time by the change in thickness of the layer per unit of polishing time. The required change in dimension of the sacrificial member is then computed by multiplying the desired thickness of the layer at the surface of the semiconductor wafer by the relative change value.

BRIEF DESCRIPTION OF THE DRAWINGS

Other objects and advantages of the invention will become apparent upon reading the following detailed description and upon reference to the accompanying drawings in which.

Figures 1A, 1B:
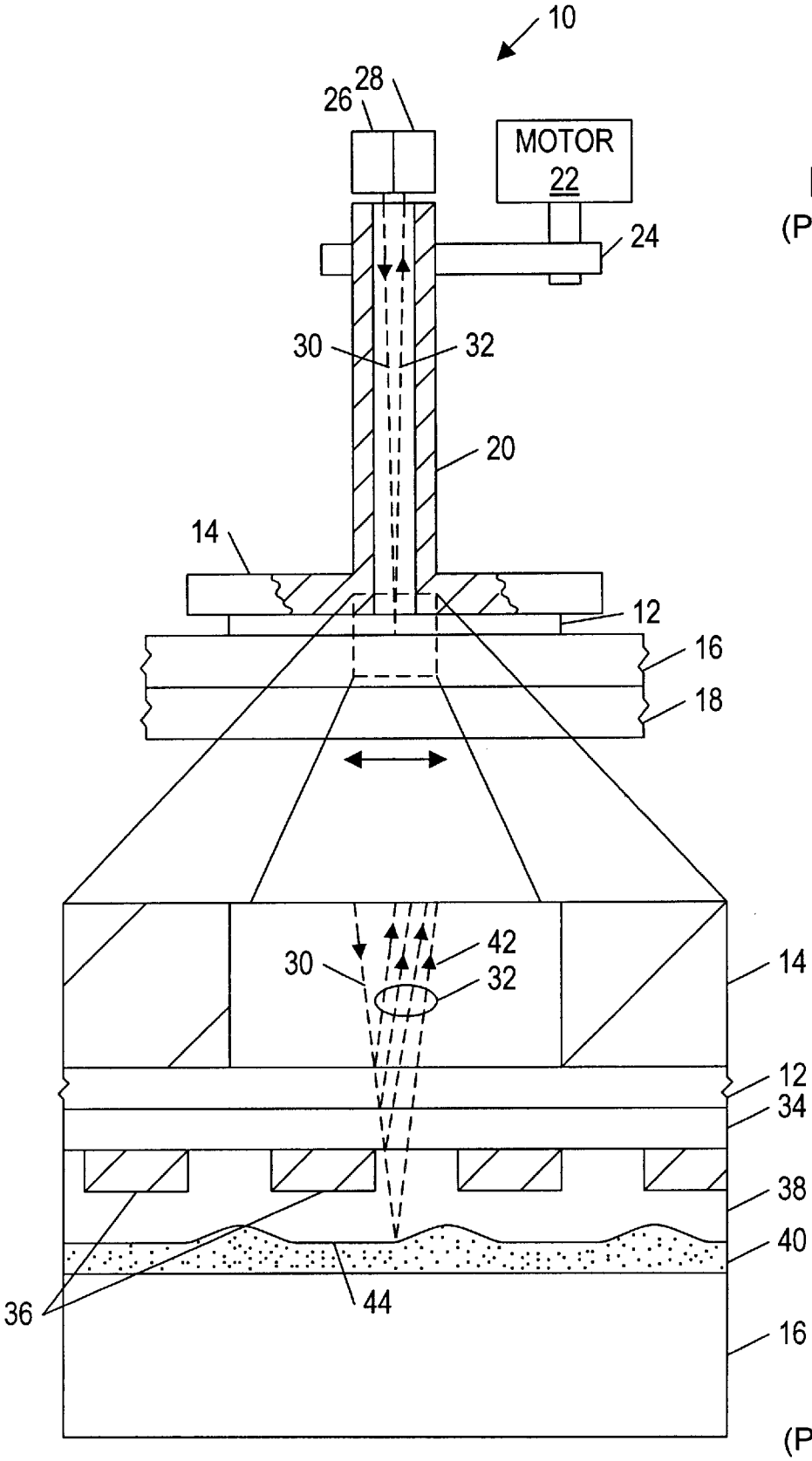
FIG. 1A (PRIOR ART)
FIG. 1B (PRIOR ART)
FIG. 1*a* is a side elevation view of an exemplary CMP apparatus and mechanism for terminating CMP of a wafer using a light beam directed through the backside surface of the wafer, wherein a portion of the light beam is reflected back from the various interfaces at the frontside surface to determine CMP completion.
FIG. 1*b* is an exploded view of the portion of FIG. 1*a* illustrating contributions from reflected light of an incident light beam, wherein as the CMP operation is continued after the exposed frontside surface becomes polished and substantially planar, relatively small but detectable cyclic changes occur in the intensity of a monitored wavelength of the reflected light beam, signaling completion of the CMP process.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Figure 2:
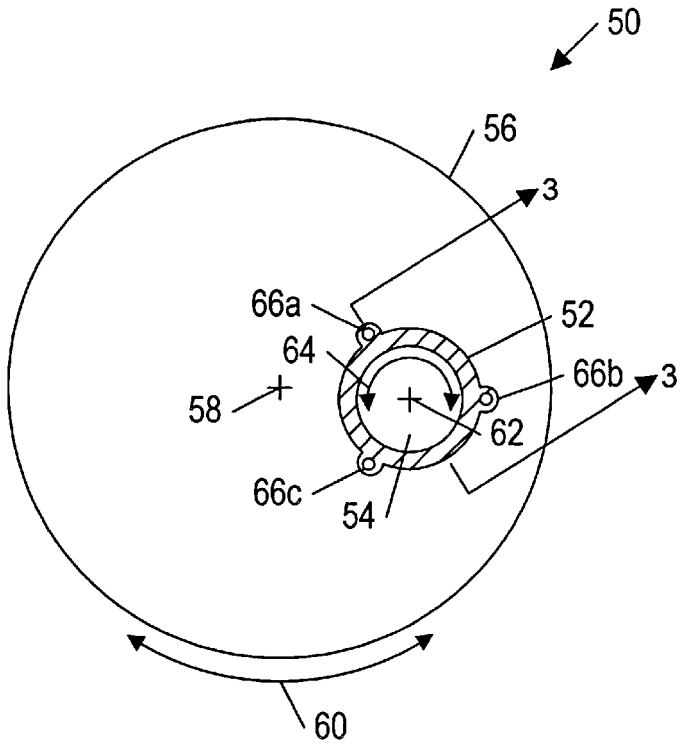
FIG. 2 is a top plan view of a first embodiment of a CMP apparatus in accordance with the present invention, wherein the CMP apparatus includes a polishing pad which rotates about a central axis and has a substantially planar polishing surface, a retaining structure for retaining the wafer and each of possibly three sacrificial members within sensor appendages against the polishing surface, and a measurement system for determining an amount of material removed from each of the sacrificial members.

Turning now to the drawings, FIG. 2 is a top plan view of a first embodiment of a CMP apparatus 50 in accordance with the present invention. CMP apparatus 50 includes a wafer retaining structure 52 which secures a frontside surface of a wafer 54 against an upper surface of a polishing pad 56. Polishing pad 56 is positioned upon an upper surface of a rotatable platen. (See FIG. 3). The platen may rotate either in a clockwise or counterclockwise direction about a central axis 58 as indicated by reference numeral 60. Polishing pad 56 rotates with the platen. Retaining structure 52 and wafer 54 may move, rotate, oscillate and/or orbit either in a clockwise or counterclockwise direction about a central axis 62 as indicated by reference numeral 64. Retaining structure 52 and semiconductor wafer 54 may also orbit around a fixed point while rotating about central axis 62. The upper surface of polishing pad 56 retains a coplanar orientation relative to the frontside surface of semiconductor wafer 54. Polishing pad 56 is made of any material which mechanically abrades a targeted material upon the frontside surface of semiconductor 54. For example, polishing pad 56 may comprise, e.g., polyurethane, suitable for removing silicon dioxide.

Polishing pad 56 is preferably saturated with a slurry forming a slurry film upon the upper surface of polishing pad 56. The slurry preferably comprises abrasive particles and a chemical which partially reacts with the exposed material on the frontside surface of wafer 54. The slurry may include, for example, silica particles, an oxidizing agent such as a potassium-based chemical, and possibly a buffer agent or an acid agent to adjust the acidity or alkalinity (i.e., the pH) of the slurry. The slurry may be applied to polishing pad 56 by forcing slurry upward through polishing pad 56 or dispensing slurry upon the upper surface of polishing pad 56.

In one example depicted in FIG. 2, retaining structure includes three sensor appendages 66*a–c*. Each sensor appendage 66 includes a sacrificial member having a surface which is retained against the upper surface of polishing pad 56. Downward-facing material of each sacrificial member is abraded concurrent with wafer abrasion during CMP. A measurement system of CMP apparatus 50 determines an amount of material removed from the surface of each sacrificial member. The average amount of material removed from the surfaces of the sacrificial members corresponds to an amount of material removed from the frontside surface of semiconductor wafer 54. A sensor unit within each sensor appendage 66 is used to measure the dimension of the corresponding sacrificial member orthogonal to the planar upper surface of polishing pad 56 (i.e., the vertical length of the corresponding sacrificial member).

A computational device determines the change in length of each sacrificial member due to abrasion, and computes a single average change in length representing all of the sacrificial members. A correlation between the material removal rates due to polishing (i.e., polish rates) of the sacrificial member and the targeted material upon the frontside surface of wafer 54 is used to determine when a desired amount of material has been removed from wafer 54. The computational device preferably produces one or more signals which control the operation of CMP apparatus 50. The computational device may, for example, issue a termination signal which causes operation of CMP apparatus 50 to cease when a desired amount of material has been removed from the frontside surface (i.e., downward-facing surface) of wafer 54.

Figure 3:
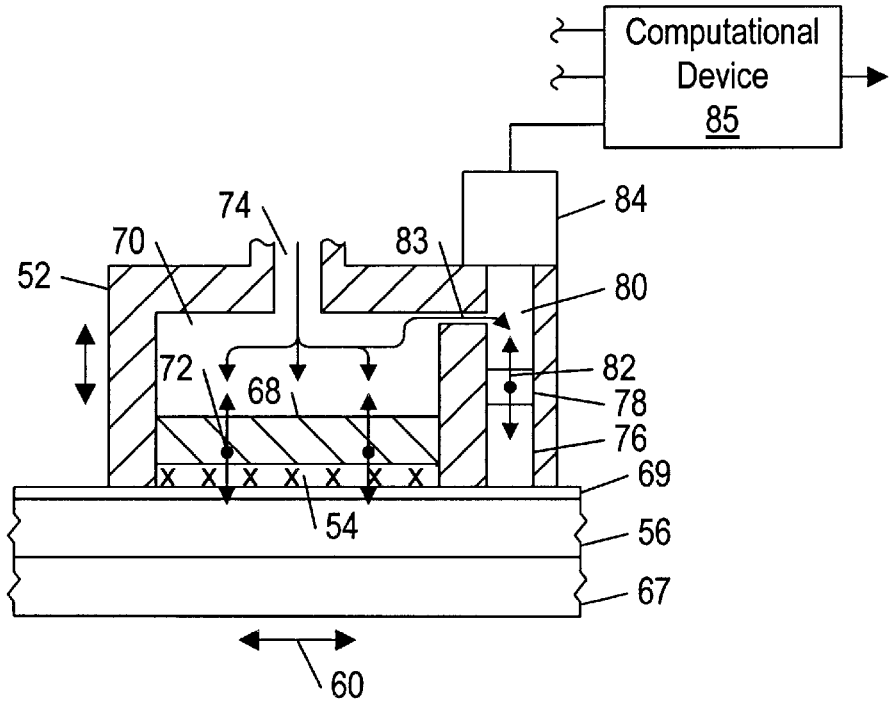
FIG. 3 is a cross-sectional view of the retaining structure of FIG. 2 viewed along plane 3 of FIG. 2, wherein fluid pressure within a central chamber and a sensor chamber urges the wafer and a sacrificial member, respectively, toward the polishing pad.

FIG. 3 is a cross-sectional view of retainer 52 viewed along plane 3 of FIG. 2. Retainer 52 includes a wafer carrier 68 arranged within a cylindrical central chamber 70 of retaining structure 52. Wafer carrier 68 holds wafer 54 in position against a slurry film 69 across the upper surface of polishing pad 56 during operation of CMP apparatus 50. Polishing pad 56 is positioned upon an upper surface of a rotatable platen 67. Wafer carrier 68 slides up and down within central chamber 70, as indicated by reference numeral 72, depending upon an amount of pressure exerted upon a backside surface of wafer carrier 68. During operation of CMP apparatus 50, a fluid is introduced into central chamber 70 through an opening 74 such that pressure is exerted upon the backside surface of wafer carrier 68. The fluid may be a gas or a liquid. The pressure causes wafer carrier 68 to move downward, urging the frontside surface of semiconductor wafer 54 toward the upper surface of polishing pad 56.

The backside surface of semiconductor wafer 54 may be secured to a frontside surface of wafer carrier 68 by various mechanical means, such as vacuum pressure through port openings, an adhesive, or a wax or poromeric film. The diameter of cylindrical central chamber 70 is dimensioned only slightly larger than (e.g., several hundred microns larger than) the diameter of wafer 54 in order to prevent lateral movement of semiconductor wafer 54 within retaining structure 52 during operation of CMP apparatus 50.

Retaining structure 52 is configured to retain exposed surfaces of three sacrificial members against slurry film 69 across the upper surface of polishing pad 56. The elements of only one sensor appendage 66*a* are shown in FIG. 3. It is noted that the elements of sensor appendages 66*b–c* are identical to the elements of sensor appendage 66*a*. Sensor appendage 66*a* includes a disk 78 arranged within a cylindrical sensor chamber 80 of retaining structure 52. Disk 78 positions sacrificial member 76 during operation of CMP apparatus 50 such that an exposed surface of sacrificial member 76 contacts the upper surface of polishing pad 56. Disk 78 slides up and down within sensor chamber 80, as indicated by reference numeral 82, depending upon an amount of pressure exerted upon a backside surface of disk 78. A regulated opening 83 extending between central chamber 70 and sensor chamber 80 allows the fluid introduced into central chamber 70 to also enter (by a regulated amount) sensor chamber 80. The fluid exerts pressure upon the backside surface of disk 78, causing disk 78 to move downward commensurate with wafer carrier 68 movement.

It is noted that sacrificial member 76 may be made of any material which can be polished, provided a correlation can be determined between the amount of material removed from the surface the sacrificial member and the amount of material removed from the frontside surface of semiconductor wafer 54 during polishing.

Figure 4A:
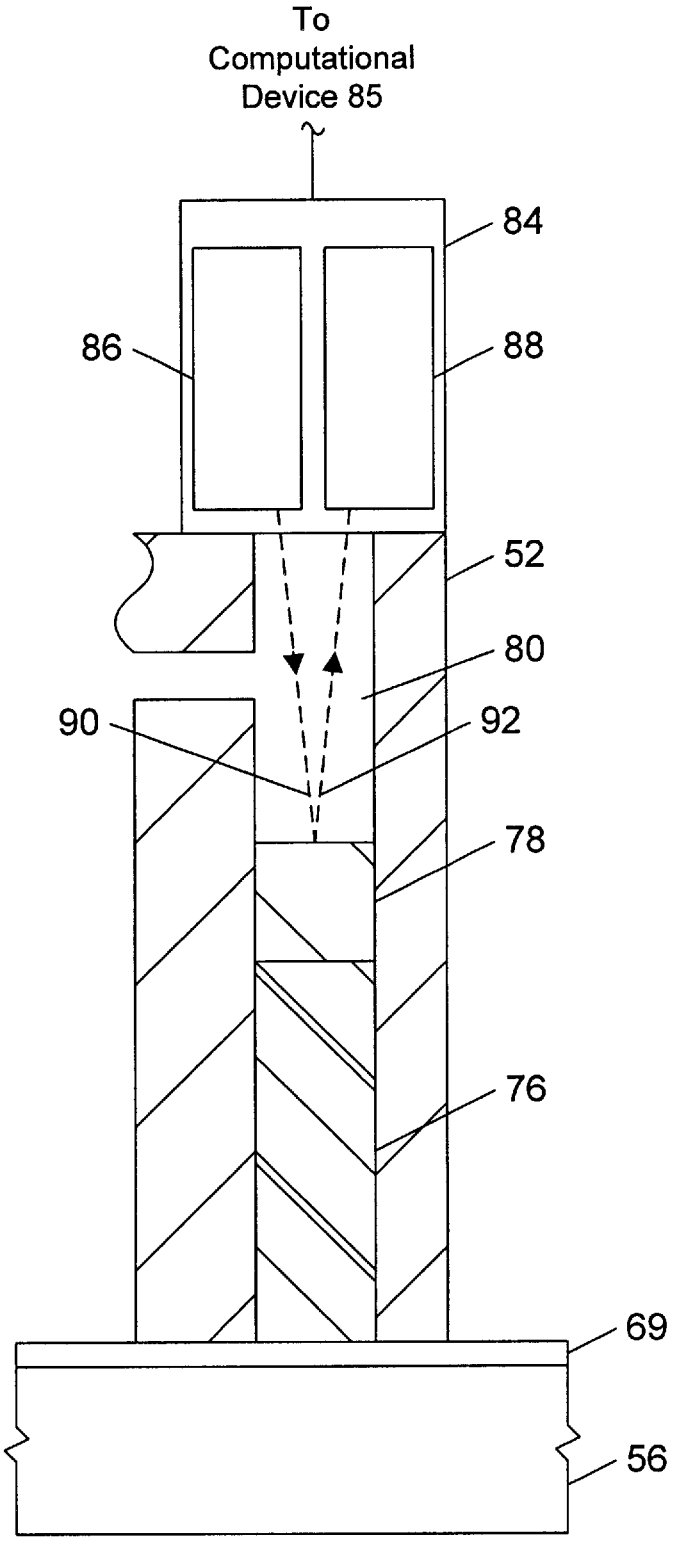
FIG. 4*a* is an exploded view of the sensor appendage portion of FIG. 3 according to one embodiment, wherein a sensor unit of the sensor appendage includes a transmitter and a receiver for transmitting a signal and receiving a portion of a signal reflected from an upper surface of a disk embodying the sacrificial material, and wherein the amount of time between transmission of the signal by the transmitter and reception of the reflected portion by the receiver is used to determine the length of the sacrificial member.

Sensor appendage 66*a* of retaining structure 52 also includes a sensor unit 84 for measuring the dimension of sacrificial member 76 orthogonal to the upper surface of polishing pad 56 (i.e., the length of sacrificial member 76) during operation of CMP apparatus 50. The sensor unit of each sensor appendage is coupled to a computational device 85. FIG. 4*a* is an exploded view of the sensor appendage 66*a* portion of FIG. 3 illustrating one embodiment of sensor appendage 66*a*. Sensor unit 84 includes a transmitter 86 and a receiver 88. An underside surface of sensor unit 84 adjoins the upper surface of retainer 52 and forms an upper wall of sensor chamber 80.

Transmitter 86 periodically transmits a signal 90 under the control of computational device 85. Signal 90 is preferably an optical signal (e.g., visible, infrared, or ultraviolet light). Alternately, signal 90 may be sound or radio waves. Transmitter 86 and receiver 88 are arranged such that a reflected portion 92 of signal 90 reflected from the upper surface of disk 78 is received by receiver 88. The upper surface of disk 78 is desirably highly reflective to signal 90 in order to make reflected portion 92 as large as possible. When signal 90 is light, disk 78 and sacrificial member 76 may be substantially opaque to signal 90. Computation device 85 measures the amount of time between transmission of signal 90 by transmitter 86 and reception of reflected portion 92 by receiver 88. The length of sacrificial member 76 may be determined using previously obtained calibration data which relates signal travel time to the length of sacrificial member 76. Computational device 85 uses a current length value along with past length values to determine a change in length of sacrificial member 76 (i.e., an amount of material removed from the exposed surface of sacrificial member 76). Such "time of flight" distance measurements are advantageously absolute, additionally allowing an indication of when sacrificial member 76 needs to be replaced.

Figure 4B:
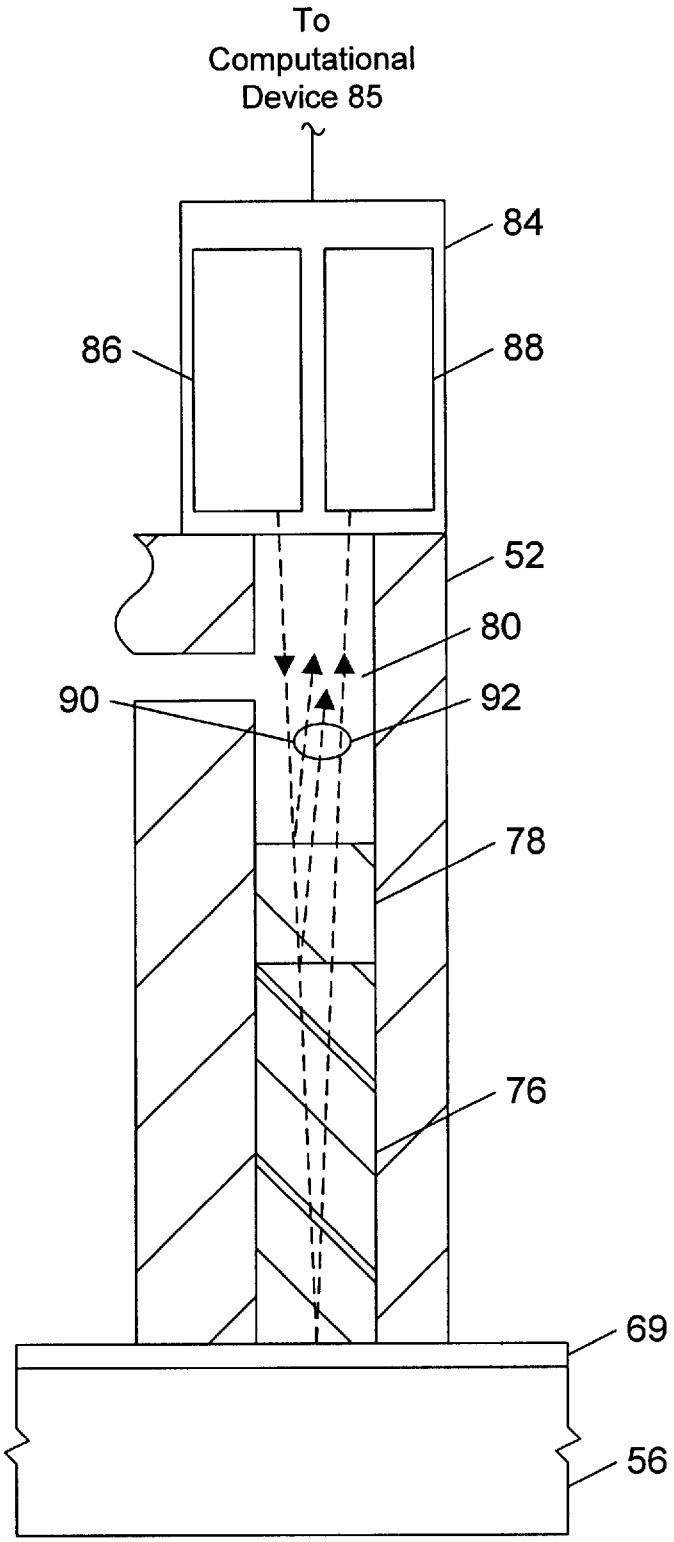
FIG. 4*b* is an exploded view of the sensor appendage portion of FIG. 3 according to an alternate embodiment, wherein the transmitter transmits a continuous signal having a constant amplitude (i.e., light having a constant intensity), and wherein the disk and the sacrificial member are made of materials which are substantially transparent to signal, and wherein the reflected signal includes contributions from reflections at interfaces between the fluid within the sensor chamber and the disk, between the disk and the sacrificial member, and from the polished exposed surface of the sacrificial member, and wherein as material is removed from the exposed surface of the sacrificial member, substantial cyclic changes occur in the intensity of a monitored wavelength of the reflected signal, and wherein the change in length of the sacrificial member is determined by counting the number of cycles in the intensity of the monitored wavelength of the reflected signal.

FIG. 4*b* is an exploded view of the sensor appendage 66*a* portion of FIG. 3 illustrating an alternate embodiment of sensor appendage 66*a*. Sensor unit 84 again includes a transmitter 86 and a receiver 88. In this case, however, transmitter 86 transmits a continuous optical signal 90 (e.g., visible, infrared, or ultraviolet light) having a constant intensity. Disk 78 and sacrificial member 76 are made of materials which are substantially transparent to optical signal 90. According to an alternative embodiment, disk 78 can be absent. Foregoing disk 78 allows measurement directly upon sacrificial member 76 without any intervening disk material or disk media. Disk 78 and sacrificial member 76 preferably have substantially equal indices of refraction so as to minimize reflection at the interface between disk 78 and sacrificial member 76. Transmitter 86 and receiver 88 are arranged such that a reflected signal 92 is received by receiver 88. Reflected signal 92 includes contributions from components resulting from reflections at interfaces between the fluid within sensor chamber 80 and disk 78, between disk 78 and sacrificial member 76, and from the downward-facing, polished surface of sacrificial member 76. As described above, the reflected components interfere with one another, adding together to produce a greater intensity when they are in phase with one another and subtracting from one another to produce a lesser intensity when they are out of phase. As material is removed from the exposed surface of sacrificial member 76, the amount of phase change experienced by light passing through sacrificial member 76 varies. As a result, substantial cyclic changes occur in the intensity of a monitored wavelength of reflected signal 92. Computational device 85 determines the change in length of sacrificial member 76 during a CMP operation by counting the number of cycles in the intensity of a monitored wavelength of reflected signal 92, where each cycle represents a change in length of sacrificial member 76 equal to a calculable fraction of the wavelength of the monitored portion of reflected signal 92. It is noted that only a small number of reflected components influence the distance measurement, and the distance measurement is independent of the number of layers upon the frontside surface of semiconductor wafer 54.

Figure 5:
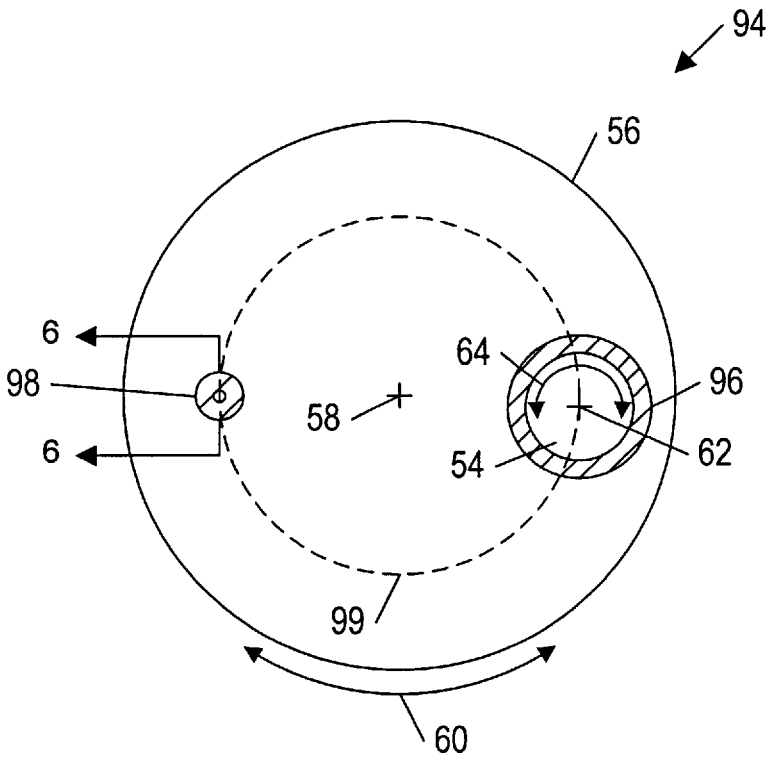
FIG. 5 is a top plan view of a second embodiment of the CMP apparatus including a retaining ring which retains the frontside surface of the wafer against the polishing pad while also retaining a sensor element containing a sacrificial member separate from the retaining ring.

FIG. 5 is a top plan view of a second embodiment of a CMP apparatus 94 in accordance with the present invention. CMP apparatus 94 includes a semiconductor retaining ring 96 which retains a frontside surface of semiconductor wafer 54 against an upper surface of polishing pad 56. Retaining ring 96 is retaining structure 52 absent sensor appendages 66*a–c* and the openings between central chamber 70 and the sensor chambers of the sensor appendages. Polishing pad 56 and the underlying rotatable platen may rotate either in a clockwise or counterclockwise direction about central axis 58 as indicated by reference numeral 60. Retaining ring 96 and wafer 54 may rotate either in a clockwise or counterclockwise direction about central axis 62 as indicated by reference numeral 64. Retaining ring 96 and semiconductor wafer 54 may also orbit around a fixed point while rotating about central axis 62.

CMP apparatus 94 also includes a sensor element 98 separate from retaining ring 96. Sensor element 98 is used to determine when a CMP operation is complete. Sensor element 98 is preferably positioned along a circle 99 defined around central axis 58 and having a radius equal to the distance between central axis 58 and central axis 62. In this way, the angular velocity of polishing pad 56 under sensor element 98 is equal to the angular velocity at the center of semiconductor wafer 54 during operation of CMP apparatus 94.

Figure 6:
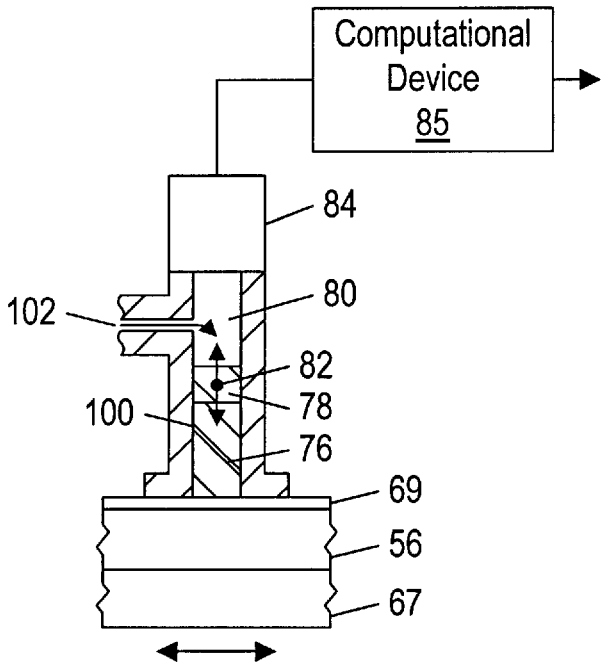
FIG. 6 is a cross-sectional view of the sensor element of FIG. 5 viewed along plane 6 of FIG. 5, wherein fluid pressure within a sensor chamber of a housing of the sensor element urges a disk and an underlying sacrificial member toward the polishing pad.

FIG. 6 is a cross-sectional view of sensor element 98 viewed along plane 6 of FIG. 5. Sensor element 98 includes a housing 100 having cylindrical sensor chamber 80 formed therein. Sensor element 98 also includes disk 78 arranged within cylindrical sensor chamber 80. During operation of CMP apparatus 94, a fluid is introduced into sensor chamber 80 through an opening 102 such that pressure is exerted upon the backside surface of disk 78. The fluid may be a gas or a liquid. The pressure causes disk 78 to move downward, urging the exposed surface of sacrificial member 76 toward the upper surface of polishing pad 56. Sensor element 98 also includes sensor unit 84 for periodically determining the length of sacrificial member 76 during operation of CMP apparatus 94. An underside surface of sensor unit 84 adjoins an upper surface of housing 100 and forms an upper wall of sensor chamber 80.

Figure 7:
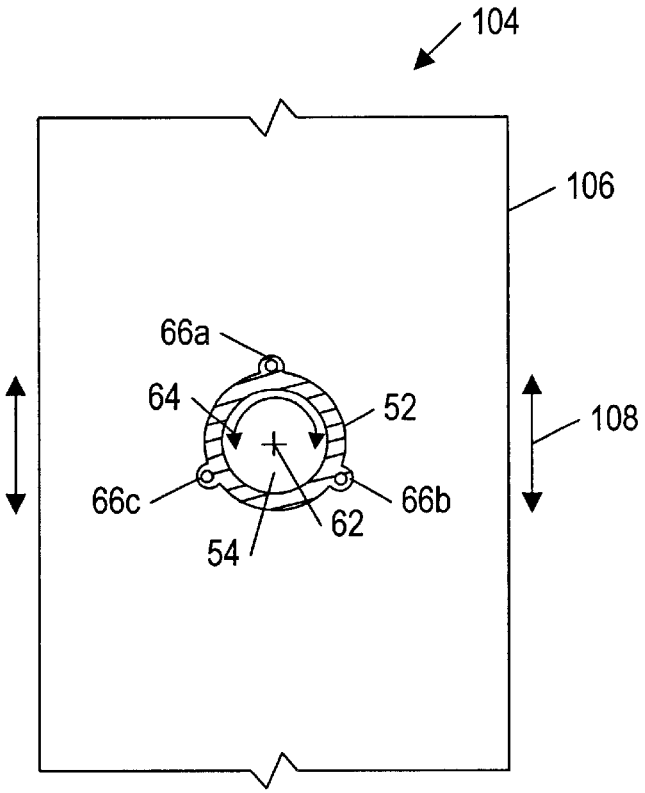
FIG. 7 is a top plan view of a third embodiment of the CMP apparatus wherein the retaining structure of FIGS. 2–4 is positioned upon a linear moving polishing pad.

FIG. 7 is a top plan view of a third embodiment of a CMP apparatus 104 wherein retaining structure 52 is positioned upon a linear moving polishing pad 104. Thus, instead of positioning semiconductor wafers upon a rotating polishing pad, the polishing pad can be directed in a linear motion, possibly along a belt. The belt surface can comprise a polyurethane or fabric-covered polyurethane surface to form polishing pad 106 which moves in a linear direction 108 relative to retaining structure 52. Retaining structure 52 and semiconductor wafer 54 may rotate either in a clockwise or counterclockwise direction about central axis 62 as indicated by reference numeral 64. Retaining structure 52 and semiconductor wafer 54 may also orbit around a fixed point while rotating about central axis 62.

Figure 8:
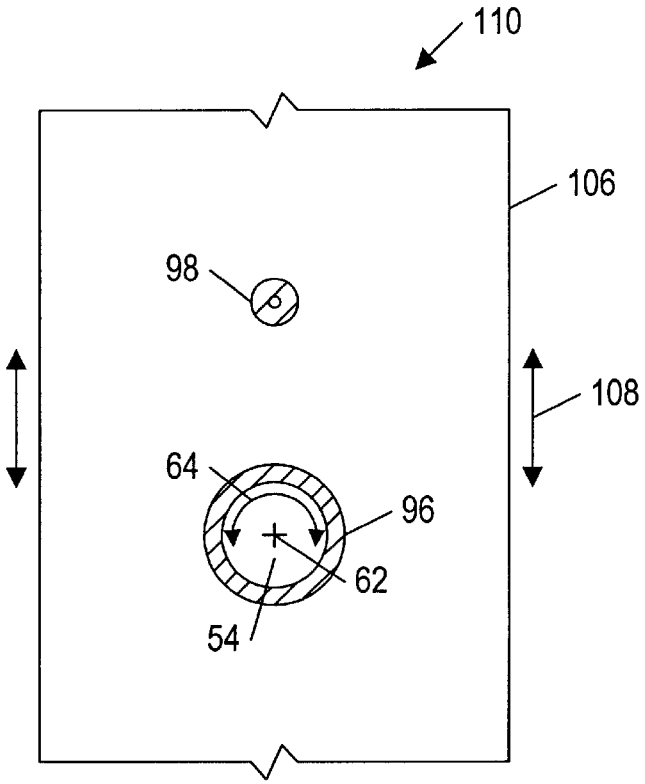
FIG. 8 is a top plan view of a fourth embodiment of the CMP apparatus wherein the retaining ring and separate sensor element of FIGS. 5–6 are positioned upon a linear moving polishing pad.

FIG. 8 is a top plan view of a fourth embodiment of a CMP apparatus 110 wherein retaining ring 96 and separate sensor element 98 are positioned upon linear moving polishing pad 106. Retaining ring 96 and semiconductor wafer 54 may rotate either in a clockwise or counterclockwise direction about central axis 62 as indicated by reference numeral 64. Retaining ring 96 and semiconductor wafer 54 may also orbit around a fixed point while rotating about central axis 62. Sensor element 98 may be positioned at any point on the upper surface of polishing pad 106 as the velocity of polishing pad 106 under sensor element 98 will always be equal to the velocity at the center of semiconductor wafer 54 during operation of CMP apparatus 110.

As described above, a correlation between the material removal rates due to polishing (i.e., polish rates) of sacrificial member 76 and the targeted material upon the frontside surface of semiconductor wafer 54 is used to determine when a desired amount of material has been removed from the frontside surface of semiconductor wafer 54. Prior to use of the CMP apparatus, a correlation procedure is preferably performed. In an exemplary correlation procedure, separate graphs of the change in the length of sacrificial member 76 and the change in the thickness of the exposed layer at the frontside surface of semiconductor wafer 54 versus CMP processing time are generated. These graphs are then used in order to determine how much material must be removed at the exposed surface of sacrificial member 76 in order to simultaneously remove a desired amount of material from the frontside surface of semiconductor wafer 54.

Figure 9A:
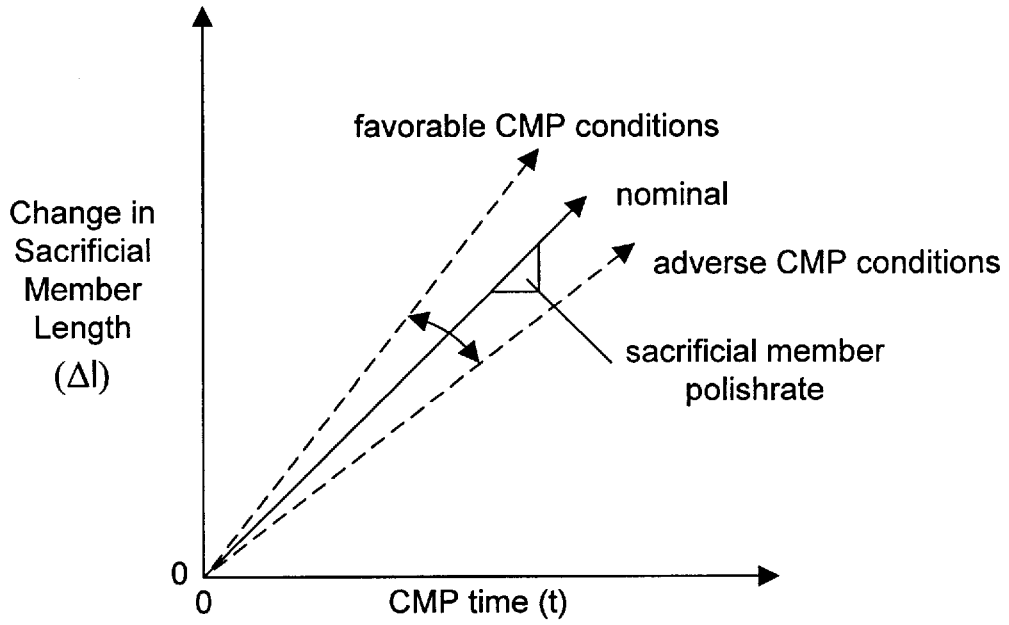
FIG. 9*a* is an exemplary graph of the change in the length of the sacrificial member of FIGS. 3–4 and 6 ($\Delta l$) versus CMP processing time (t); wherein the change in length of the sacrificial member (i.e., the change in dimension of the sacrificial member orthogonal to the planar upper surface of the polishing pad) is a linear function of CMP processing time, and wherein the slope of the line represents the change in length of the sacrificial member per unit of polishing time (i.e., the polish rate of the sacrificial member)

FIG. 9*a* is an exemplary graph of the change in the length of sacrificial member 76 (Δl) versus CMP processing time (t). In FIG. 9*a*, the change in length of sacrificial member 76 (i.e., the change in dimension of sacrificial member 76 orthogonal to the planar upper surface of polishing pad 56) is a linear function of CMP processing time. The slope of the line represents the change in length of sacrificial member 76 per unit of polishing time (i.e., the polish rate of sacrificial member 76) and varies with conditions present during the CMP process. For example, the polish rate of sacrificial member 76 is expected to depend upon the amount of downward force applied to sacrificial member 76 by disk 78, the rotational speed of polishing pad 56 (or the linear speed of polishing pad 106), characteristics and condition of the polishing pad, and slurry chemistry.

Figure 9B:
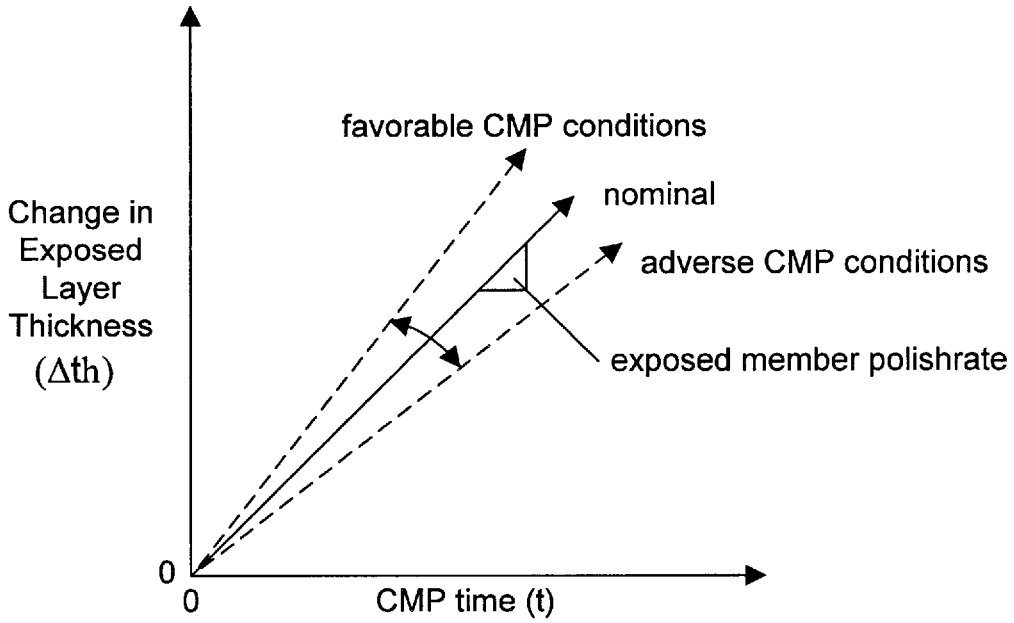
FIG. 9*b* is an exemplary graph of the change in the thickness of the exposed layer at the frontside surface of the semiconductor wafer ($\Delta th$) versus CMP processing time (t); wherein the change in the thickness is an idealized linear function of CMP processing time; and wherein the slope of the line represents the change in thickness of the exposed layer per unit of polishing time (i.e., the polish rate of the exposed layer).

FIG. 9*b* is an exemplary graph of the change in the thickness of the exposed layer at the frontside surface of semiconductor wafer 54 (Δth) versus CMP processing time (t). In FIG. 9*b*, the change in the thickness is an idealized linear function of CMP processing time. The slope of the line represents the change in thickness of the exposed layer per unit of polishing time (i.e., the polish rate of the exposed layer), and varies with conditions present during the CMP process as described above.

FIGS. 9*a–b* are used to determine a relationship between a desired final thickness of the exposed layer at the frontside surface of semiconductor wafer 54 and the corresponding change in length of sacrificial member 76 which must be achieved. The graphical relationships between FIGS. 9*a–b* can be expressed as follows:

$\Delta l$=(sacrificial member polish rate)·t $\Delta th$=(exposed layer polish rate)·t $\Delta l$=[(sacrificial member polish rate)/(exposed layer polish rate)]·$\Delta th$ $\Delta l = k \cdot \Delta th$, k=[(sacrificial member polish rate)/(exposed layer polish rate)]

Note that using FIG. 9*b* alone to determine a CMP processing time to effect the desired final thickness of the exposed layer at the frontside surface of semiconductor wafer 54 will result in a wide variance in achieved final thicknesses of exposed layers due to changing CMP conditions. On the other hand, using the change in length of sacrificial member 76 to trigger termination of CMP processing will result in a much smaller variance in the final thicknesses of exposed layers despite changing CMP conditions. This is because the polish rates of sacrificial member 76 and the exposed layer are similarly affected by the changing CMP conditions. For example, when the CMP conditions are favorable, both the sacrificial member polish rate and the exposed layer polish rate increase. Similarly, when the CMP conditions are adverse, both the sacrificial member polish rate and the exposed layer polish rate decrease. When the polish rates of sacrificial member 76 and the exposed layer are equally affected by the changing conditions, the variance in the final thicknesses of exposed layers are potentially greatly reduced.

It is also noted that monitoring the change in length of sacrificial member 76 as a function of time during CMP processing will also permit a relative assessment of CMP conditions via the sacrificial member polish rate. Such an assessment will allow corrective actions to be taken to improve adverse CMP conditions (e.g., poor polishing pad condition).

It will be appreciated to those skilled in the art having the benefit of this disclosure that this invention is believed to be capable of polishing removal of a select amount of material from a surface of a semiconductor wafer. It is intended that the following claims be interpreted to embrace all such modifications and changes and, accordingly, the specification and drawings are to be regarded in an illustrative rather than a restrictive sense.

What is claimed is:

1. An apparatus for removing film from a wafer, comprising:

a polishing pad having a moveable polishing surface for simultaneously receiving both the wafer and a sacrificial member spaced from the wafer; and a measurement system for detecting an amount of material removed from the sacrificial member during polishing of said wafer and said sacrificial member and for correlating said amount to said film removed from the wafer.

2. The apparatus as recited in claim 1, wherein the measurement system comprises:

a sensor unit, comprising:

a transmitter for transmitting a signal; and a receiver for receiving a reflected portion of the signal which conveys information as to the amount of material removed from the sacrificial member; and a computational device for determining the amount of material removed from the sacrificial member based upon an amount of material remaining at the surface of the sacrificial member.

3. The apparatus as recited in claim 2, further comprising a retainer adapted for slideably retaining the wafer, said retainer comprising a first opening dimensioned to secure the wafer therein.

4. The apparatus as recited in claim 3, wherein the first opening extends into a first chamber along an axis substantially orthogonal to the polishing surface.

5. The apparatus as recited in claim 4, wherein the retainer further comprises a second opening extending into a second chamber along an axis spaced from the axis of the first opening.

6. The apparatus as recited in claim 5, wherein said second opening is adapted for slideably retaining a sacrificial member.

7. The apparatus as recited in claim 4, wherein the retainer further comprises a wafer carrier positioned within the first chamber and adapted to move axially within the first chamber such that the wafer is moveably interposed between the wafer carrier and the polishing pad, and wherein the first chamber comprises an opening through which a fluid is introduced into the first chamber during use such that the fluid exerts pressure upon the wafer carrier, urging the wafer carrier and the wafer toward the polishing surface.

8. The apparatus as recited in claim 5, wherein the retainer comprises a disk positioned within the second chamber and adapted to move axially within the second chamber such that the sacrificial member is moveably interposed between the disk and the polishing pad, and wherein the retaining structure comprises an opening extending between the first and second chamber which allows the fluid introduced into the first chamber to also enter the second chamber, and wherein during use the fluid exerts pressure upon the disk, urging the disk and the sacrificial member toward the polishing surface.

9. The apparatus as recited in claim 8, wherein a surface of the sensor unit forms an upper wall of the second chamber.

10. The apparatus as recited in claim 3, further comprising a sensor spaced separate from the retainer, wherein the sensor element comprises a sensor chamber open at an underside surface of the sensor chamber to receive the sacrificial member.

11. The apparatus as recited in claim 10, wherein the sensor chamber is cylindrical, and wherein an axis of the sensor chamber is substantially orthogonal to the polishing surface.

12. The apparatus as recited in claim 11, wherein the sensor element comprises a disk positioned within the sensor chamber and adapted to move along the axis of the sensor chamber, wherein the sacrificial member is interposed between the disk and the polishing pad, and wherein the sensor chamber comprises an opening through which a fluid is introduced into the sensor chamber during use such that the fluid exerts pressure upon the disk, urging the disk and the sacrificial member toward the polishing surface.

13. The apparatus as recited in claim 11, wherein a surface of the sensor unit forms an upper wall of the sensor chamber.

14. The apparatus as recited in claim 9, wherein the polishing pad rotates about a central axis, and wherein the radial distances of the axes of the sensor chamber and the first chamber from the central axis are equal.

15. An apparatus for removing material from a surface of a semiconductor wafer, comprising:

a polishing pad having a moveable planar polishing surface;

a plurality of sacrificial members;

a retaining structure for retaining surfaces of the semiconductor wafer and each of the sacrificial members against the polishing surface of the polishing pad; and a measurement system for determining an amount of material removed from each of the sacrificial members, wherein the average amount of material removed from the surfaces of the sacrificial members corresponds to an amount of material removed from the surface of the semiconductor wafer.

16. The apparatus as recited in claim 15, wherein the measurement system comprises:

a plurality of sensor units equal in number to the number of sacrificial members, wherein each sensor unit comprises:

a transmitter for transmitting a signal; and a receiver for receiving a reflected portion of the signal, wherein the reflected portion of the signal conveys information as to the amount of material remaining at the surface of the corresponding sacrificial member; and a computational device for determining:

the amount of material removed at the surface of each sacrificial member based upon the amount of material remaining at the surface of the sacrificial member; and the average amount of material removed from the surfaces of the sacrificial members.

17. The apparatus as recited in claim 15, wherein the retaining structure rotates about an axis through the center of the semiconductor wafer and orthogonal to the planar polishing surface of the polishing pad.

18. A method of achieving a desired thickness of a layer of a material upon a surface of a semiconductor wafer, comprising:

providing an apparatus, comprising:

a polishing pad having a moveable planar polishing surface;

a retaining structure for retaining the surface of the semiconductor wafer against the polishing surface of the polishing pad;

a sacrificial member, wherein a surface of the sacrificial member is retained against the polishing surface of the polishing pad; and a measurement system for determining a change in dimension of the sacrificial member orthogonal to the planar polishing surface of the polishing pad;

determining a required change in dimension of the sacrificial member orthogonal to the planar polishing surface of the polishing pad which corresponds to the desired final thickness of the layer upon the surface of the semiconductor wafer; and moving the polishing pad relative to the surfaces of the semiconductor wafer and the sacrificial member until the required change of dimension of the sacrificial member is achieved.

19. The method as recited in claim 18, wherein the determining step comprises:

determining the change in thickness of the layer upon the surface of the semiconductor wafer per unit of polishing time;

determining the change in dimension of the sacrificial member orthogonal to the planar polishing surface of the polishing pad per unit of polishing time;

calculating a relative change value by dividing the change in dimension of the sacrificial member per unit of polishing time by the change in thickness of the layer per unit of polishing time; and multiplying the desired thickness of the layer at the surface of the semiconductor wafer by the relative change value.

* * * * *